US009858854B2

(12) United States Patent
Seo et al.

(10) Patent No.: US 9,858,854 B2
(45) Date of Patent: Jan. 2, 2018

(54) DISPLAY WITH VARIABLE INPUT FREQUENCY

(71) Applicant: SAMSUNG DISPLAY CO., LTD., Yongin-Si, Gyeonggi-Do (KR)

(72) Inventors: Ji-Myoung Seo, Hwaseong-Si (KR); Dong-Won Park, Hwaseong-Si (KR); Jae Wan Park, Seoul (KR); Po-Yun Park, Seoul (KR); Hong-Kyu Kim, Suwon-Si (KR); Bonghyun You, Seongnam-Si (KR); Jung-Hwan Cho, Asan-Si (KR)

(73) Assignee: SAMSUNG DISPLAY CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 15/092,863

(22) Filed: Apr. 7, 2016

(65) Prior Publication Data

US 2017/0069256 A1 Mar. 9, 2017

(30) Foreign Application Priority Data

Sep. 3, 2015 (KR) ..... 10-2015-0124735

(51) Int. Cl.

*G09G 5/00* (2006.01)
*G09G 3/20* (2006.01)
*G09G 3/36* (2006.01)

(52) U.S. Cl.

CPC ..... *G09G 3/2096* (2013.01); *G09G 3/3614* (2013.01); *G09G 3/3696* (2013.01); *G09G 2330/023* (2013.01); *G09G 2340/0435* (2013.01); *G09G 2360/18* (2013.01)

(58) Field of Classification Search

CPC ..... G09G 3/2096; G09G 3/3696; G09G 2340/0435; G09G 3/3614; G09G 2360/18

See application file for complete search history.

(56) References Cited

U.S. PATENT DOCUMENTS

2002/0030673 A1* 3/2002 Ikemoto ..... G09G 3/20 345/204
2006/0007093 A1* 1/2006 La ..... G09G 3/3614 345/96

(Continued)

FOREIGN PATENT DOCUMENTS

KR 1020160093153 8/2016

OTHER PUBLICATIONS

U.S. Appl. No. 14/725,613, filed May 29, 2016.

*Primary Examiner* — Yuzhen Shen
(74) *Attorney, Agent, or Firm* — F. Chau & Associates, LLC

(57) ABSTRACT

A display apparatus includes a display panel comprising a plurality of data lines and a plurality of gate lines crossing the plurality of data lines, a frequency detector configured to receive an input synchronization signal with an input frequency which is varying in a preset frequency range and to count clock cycles of an input frame in the input synchronization signal, and a synchronization signal generator configured to generate an output synchronization signal which has an insertion frame corresponding to a frame of maximum frequency within the preset frequency range and inset the insertion frame in a vertical blanking period of the input frame, based on the clock count.

10 Claims, 14 Drawing Sheets

(56) References Cited

U.S. PATENT DOCUMENTS

| | | | | |
|---|---|---|---|---|
| 2012/0099017 | A1* | 4/2012 | Wester | H04N 7/01 348/441 |
| 2013/0106876 | A1* | 5/2013 | Lee | G06F 13/14 345/520 |
| 2014/0354625 | A1* | 12/2014 | Shin | G09G 3/3648 345/215 |
| 2014/0368484 | A1 | 12/2014 | Tanaka et al. | |
| 2015/0002525 | A1* | 1/2015 | Chiang | G09G 5/18 345/547 |
| 2015/0022747 | A1 | 1/2015 | Hong et al. | |
| 2016/0117995 | A1 | 4/2016 | Lee et al. | |

* cited by examiner

FIG. 6

| | FB1 | FB2 | FB3 | FB4 | FB5 | FB6 |
|---|---|---|---|---|---|---|
| t1 | DN | | | | | |
| t2 | DN | DN+1 | | | | |
| t3 | DN | DN+1 | DN+2 | | | |
| t4 | DN | DN+1 | DN+2 | DN+3 | | |
| t5 | DN | DN+1 | DN+2 | DN+3 | DN+4 | |
| t6 | DN+5 | DN+1 | DN+2 | DN+3 | DN+4 | |
| t7 | DN+5 | | DN+2 | DN+3 | DN+4 | DN+6 |

FIG. 13

| | FB1 | FB2 | FB3 | FB4 | FB5 |
|---|---|---|---|---|---|
| t1 | DN-1 | | | | |
| t2 | DN-1 | DN | | | |
| t3 | | DN | DN+1 | | |
| t4 | DN+2 | DN | DN+1 | | |
| t5 | DN+2 | | DN+1 | DN+3 | |
| t6 | DN+2 | DN+4 | DN+1 | DN+3 | |
| t7 | DN+2 | DN+4 | | DN+3 | DN+5 |

DISPLAY WITH VARIABLE INPUT FREQUENCY

CROSS-REFERENCE TO RELATED APPLICATION

This application claims priority from and the benefit of Korean Patent Application No. 10-2015-0124735, filed on Sep. 3, 2015, which is hereby incorporated by reference for all purposes as if fully set forth herein.

TECHNICAL FIELD

Exemplary embodiments of the inventive concept relate to a display apparatus and a method of driving the display apparatus. More particularly, example embodiments of the inventive concept relate to a display apparatus for improving a display quality, and a method of driving the display apparatus.

DISCUSSION OF RELATED ART

A display apparatus may be used in monitors, laptop computers, cellular phones, or the like, due to its small size and low power consumption. The display apparatus includes a liquid crystal display (LCD) apparatus and an Organic Light Emitting Diode (OLED) apparatus.

The display apparatus includes a display panel and a signal controller for driving the display panel. The signal controller generates a panel synchronization signal for driving the display panel using an image signal and an external synchronization signal received from a graphic processor. The panel synchronization signal controls a data driver and a gate driver which are connected to the display panel and thus, the data driver and gate driver display an image on the display panel.

The image displayed on the display panel may include a static image and a moving image. The display panel displays a plurality of frame images corresponding to a frame frequency. When the plurality of frame images are the same as each other, a static image may be displayed, and when the plurality of frame images is different from each other, a moving image may be displayed.

When a frame frequency of the external synchronization signal received from the graphic processor is not synchronized with a frame frequency of the panel synchronization signal, the image displayed on the display panel includes display defects such as tearing defects or stutter defects.

SUMMARY

Exemplary embodiments of the inventive concept provide a display apparatus for displaying an image signal with variable input frequency.

Exemplary embodiments of the inventive concept provide a method of driving the display apparatus.

According to an exemplary embodiment of the inventive concept, a display apparatus includes a display panel comprising a plurality of data lines and a plurality of gate lines crossing the plurality of data lines, a frequency detector configured to receive an input synchronization signal with an input frequency which is variable in a preset frequency range and to count clock cycles of a input frame in the input synchronization signal, a synchronization signal generator configured to generate an output synchronization signal which has an insertion frame corresponding to a frame of a maximum frequency among the preset frequency range and insets the insertion frame in a vertical blanking period of the input frame, based on the counted clock cycles, a frame data generator configured to generate insertion frame data corresponding to the insertion frame of the output synchronization signal, an inversion controller configured to generate an inversion signal which has a phase reversed by a frame unit based on the output synchronization signal, and a data driver configured to control a polarity of a data voltage based on the inversion signal and to output the data voltage to a data line.

In an exemplary embodiment, the display apparatus may further include a normal synchronization processor configured to receive the input synchronization signal with a normal frequency, to output the output synchronization signal with the normal frequency and to output frame data based on the output synchronization signal.

In an exemplary embodiment, the display apparatus may further include a memory including at least one frame buffer which stores the image signal by frame unit.

In an exemplary embodiment, a sequence number of the frame buffer may be determined based on a length of the vertical blanking period of the input synchronization signal.

In an exemplary embodiment, the memory may include a single frame buffer.

In an exemplary embodiment, the memory includes dual single frame buffers.

In an exemplary embodiment, the frame data generator may be configured to output previous input frame data as the insertion frame data.

In an exemplary embodiment, the frame data generator may be configured to output interpolation frame data generated through a Motion Estimation Motion Compensation (MEMC) method as the insertion frame data.

In an exemplary embodiment, the frame data generator may be configured to generate interpolation frame data corresponding to the last insertion frame through an MEMC method and to generate a repetition frame data corresponding to a remaining frame except for the last insertion frame, the repetition frame data being equal to previous input frame data.

According to an exemplary embodiment of the inventive concept, there is provided a display apparatus. The display apparatus includes a display panel comprising a plurality of data lines and a plurality of gate lines crossing the plurality of data lines, a frequency detector configured to receive an input synchronization signal with an input frequency which is varying in a preset frequency range and to count clock cycles of an input frame in the input synchronization signal, a synchronization signal generator configured to shift one of adjacent input frames with different input frequencies from each other based on the clock count and to generate an output synchronization signal which includes adjacent frames having a same vertical blanking period as each other, a frame data generator configured to generate frame data corresponding to a frame of the output synchronization signal, an inversion controller configured to generate an inversion signal which has a phase reversed by a frame unit based on the output synchronization signal, and a data driver configured to control a polarity of a data voltage based on the inversion signal and to output the data voltage to a data line.

According to an exemplary embodiment of the inventive concept, a method of driving a display apparatus includes receiving an input synchronization signal with an input frequency which is varying in a preset frequency range, counting clock cycles of an input frame in the input synchronization signal, generating an output synchronization signal which has an insertion frame inserted in a vertical blanking period of the input synchronization signal, the insertion frame corresponding to a frame of a maximum frequency within the preset frequency range, generating insertion frame data corresponding to the insertion frame of the output synchronization signal, generating an inversion signal which has a phase reversed by a frame unit based on the output synchronization signal, and outputting a data voltage having a polarity controlled by the inversion signal to a data line.

In an exemplary embodiment, the method may further include receiving the input synchronization signal with a normal frequency, and outputting frame data based on the output synchronization signal with the normal frequency.

In an exemplary embodiment, the method may further include storing the image signal in at least one frame buffer.

In an exemplary embodiment, a sequence number of the frame buffer may be determined by a length of the vertical blanking period of the input synchronization signal.

In an exemplary embodiment, the method may further include outputting previous input frame data as the insertion frame data using the frame buffer.

In an exemplary embodiment, the method may further include outputting interpolation frame data generated through an MEMC method as the insertion frame data.

In an exemplary embodiment, the method may further include generating the output synchronization signal which has at least one insertion frame inserted in the vertical blanking period of the input synchronization signal being longer than the frame of the maximum frequency, and adjusting a vertical blanking period of a last insertion frame to be substantially equal to a vertical blanking period of a previous insertion frame adjacent to the last insertion frame.

In an exemplary embodiment, the method may further include outputting interpolation frame data in the last insertion frame through an MEMC method, and outputting a repetition frame data in a remaining frame except for the last insertion frame, the repetition frame data being previous input frame data.

According to an exemplary embodiment of the inventive concept, a method of driving a display apparatus includes receiving an input synchronization signal with an input frequency which is varying in a preset frequency range, calculating a clock cycle count in an input frame of the input synchronization signal, shifting one of adjacent input frames with different input frequencies from each other based on the clock count to generate an output synchronization signal which includes adjacent frames having a substantially same vertical blanking period as each other, generating insertion frame data corresponding to the insertion frame of the output synchronization signal, generating an inversion signal which has a phase reversed by a frame based on the output synchronization signal, and outputting a data voltage having a polarity controlled by the inversion signal to a data line.

According to an exemplary embodiment of the inventive concept, in the free synchronization mode, different vertical blanking periods in the input synchronization signal may compensate through a frame insertion method and thus, the output synchronization signal including similar vertical blanking periods may be generated. Thus, display defects such as a tearing defect and a stuttering defect may be low. In addition, the inversion signal is generated based on the output synchronization signal including similar vertical blanking periods and thus an unequal distribution of polarities between adjacent frames may be substantially equalized and a DC afterimage may be substantially avoided.

An exemplary embodiment display driver includes: a timing controller; a memory connected to the timing controller; a data driver connected to the timing controller; and a gate driver connected to the timing controller, wherein the timing controller includes a normal synchronization processor and a free synchronization processor, at least the free synchronization processor connected to the memory.

In an exemplary embodiment display driver, the normal synchronization processor is configured to receive an input synchronization signal having a normal frequency, to output an output synchronization signal having the normal frequency, and to output frame data based on the output synchronization signal.

In an exemplary embodiment display driver, the free synchronization processor includes: a clock counter connected to the memory and configured to count clock cycles of an input frame; a synchronization signal generator connected to the clock counter and configured to generate an output synchronization signal based on the clock count; a frame data generator connected between the synchronization signal generator and the memory and configured to generate frame data for at least one frame of the output synchronization signal; and an inversion controller connected between the synchronization signal generator and the data driver and configured to generate an inversion signal having a phase reversal per frame unit based on the output synchronization signal.

In an exemplary embodiment display driver, the free synchronization processor is configured to generate the output synchronization signal including a shifted one of adjacent input frames having different input frequencies from each other where one of the adjacent frames is shifted based on the clock count to generate the output synchronization signal including the adjacent frames having a substantially same vertical blanking period as each other.

In an exemplary embodiment display driver, the free synchronization processor is configured to generate the output synchronization signal including an insertion frame corresponding to a frame of maximum frequency within the preset frequency range where the insertion frame is inset in a vertical blanking period of the input frame, and the generated insertion frame data corresponds to the insertion frame of the output synchronization signal.

In an exemplary embodiment display driver, the timing controller is configured to use the normal synchronization processor to receive an input frame data having a normal frequency, to output an output synchronization signal having the normal frequency, and to output frame data based on the output synchronization signal, or to use the free synchronization processor to select for each input frame, based on its clock count, whether to generate the output synchronization signal including a shifted one of adjacent input frames having different input frequencies from each other where one of the adjacent frames is shifted based on the clock count to generate the output synchronization signal including the adjacent frames having a substantially same vertical blanking period as each other, or to use the free synchronization processor to generate the output synchronization signal including an insertion frame corresponding to a frame of maximum frequency within the preset frequency range where the insertion frame is inset in a vertical blanking period of the input frame, and the generated insertion frame data corresponds to the insertion frame of the output synchronization signal.

In an exemplary embodiment display driver, the frame data generator is configured to output previous input frame data as the insertion frame data.

In an exemplary embodiment display driver, the frame data generator is configured to output interpolation frame data generated through a Motion Estimation Motion Compensation (MEMC) method as the insertion frame data.

In an exemplary embodiment display driver, the synchronization signal generator is configured to generate the output synchronization signal including at least one insertion frame inserted in the vertical blanking period of the input synchronization signal, the vertical blanking period being longer than the frame of the maximum frequency, and a vertical blanking period of a last insertion frame is substantially equal to a vertical blanking period of a previous insertion frame adjacent to the last insertion frame.

In an exemplary embodiment display driver, the frame data generator is configured to generate interpolation frame data corresponding to the last insertion frame through a Motion Estimation Motion Compensation (MEMC) method and to generate repetition frame data corresponding to a remaining frame other than the last insertion frame, the repetition frame data being substantially equal to previous input frame data.

BRIEF DESCRIPTION OF THE DRAWINGS

The above and other features of the inventive concept will become more apparent by describing in detail exemplary embodiments thereof with reference to the accompanying drawings, in which:

FIG. 6 is a hybrid diagram illustrating a memory according to the timing controller of FIG. 1 in correspondence with the waveform diagram in FIG. 5;

FIG. 13 is a hybrid diagram illustrating a memory according to the timing controller in FIG. 12.

DETAILED DESCRIPTION

Hereinafter, the inventive concept will be explained in detail with reference to the accompanying drawings.

Figure 1:
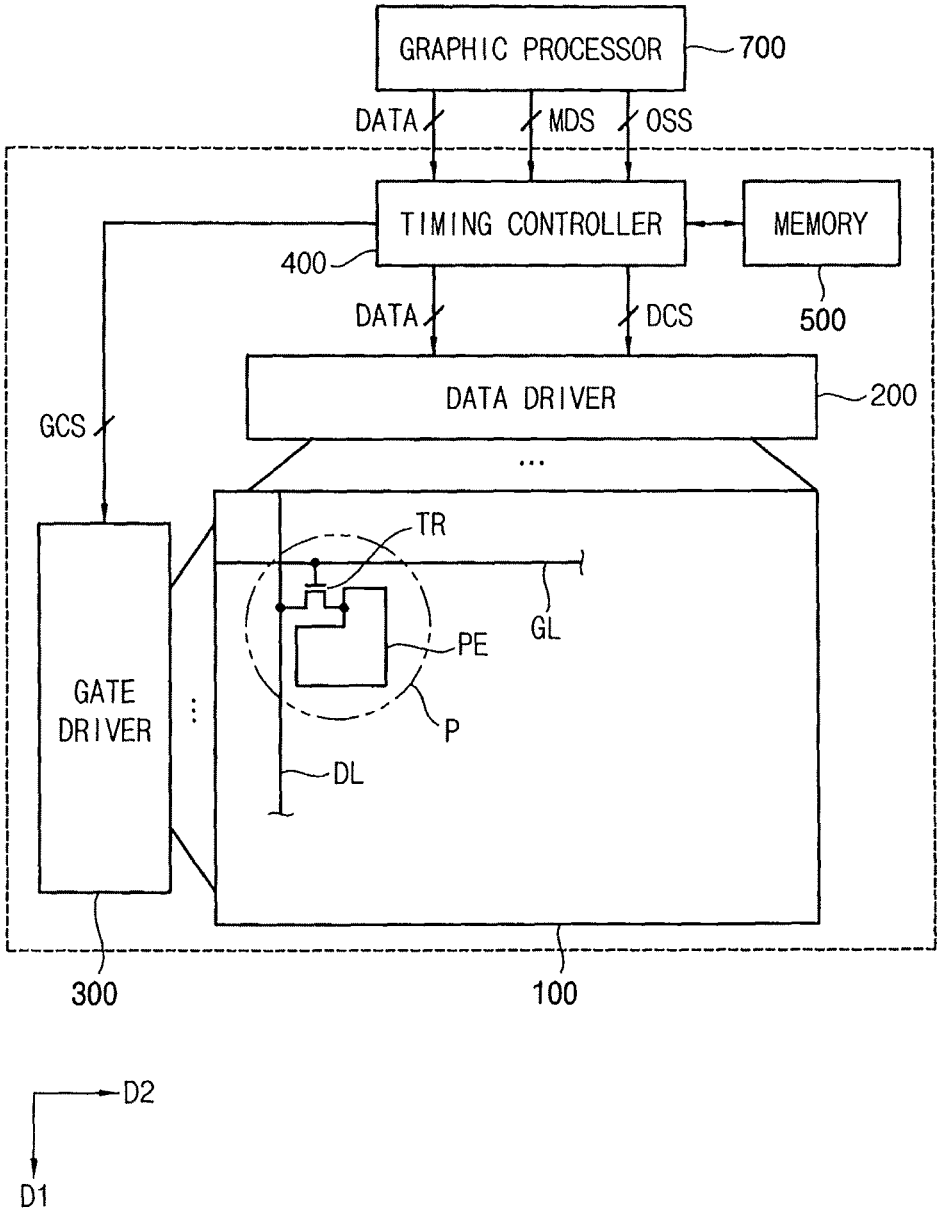
FIG. 1 is a schematic block diagram illustrating a display apparatus according to an exemplary embodiment of the inventive concept.
Figure 2:
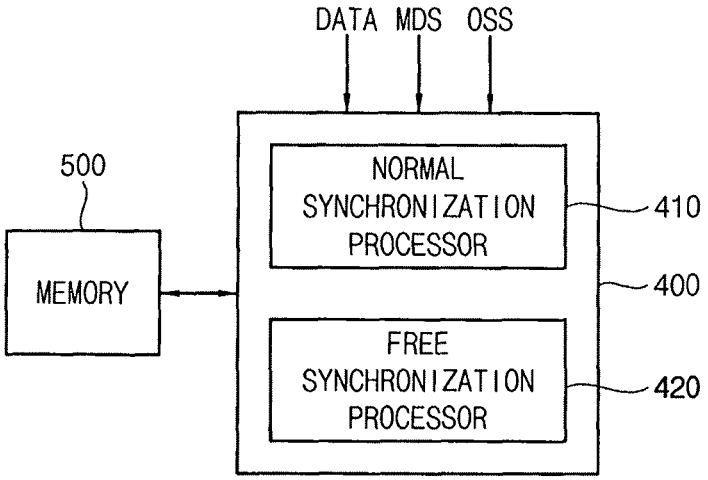
FIG. 2 is a schematic block diagram illustrating a timing controller in FIG. 1.

FIG. 1 is a block diagram illustrating a display apparatus according to an exemplary embodiment. FIG. 2 is a block diagram illustrating a timing controller in FIG. 1.

Referring to FIGS. 1 and 2, the display apparatus may include a display panel 100, a data driver 200 connected to the display panel, a gate driver 300 connected to the display panel, a timing controller 400 connected to the data driver, and a memory 500 connected to the timing controller.

The display panel 100 may include a plurality of data lines DL, a plurality of gate lines GL, and a plurality of pixels P connected between the data lines and the gate lines. The data lines DL extend in a first direction D1 and are arranged in a second direction D2 crossing the first direction D1. The gate lines GL extend in the second direction D2 and are arranged in the first direction D1. Each of the pixels P may include a thin film transistor TR which is connected to a data line and a gate line, and a pixel electrode PE which is connected to the thin film transistor TR. The pixels P are arranged as a matrix type which includes a plurality of pixel columns and a plurality of pixel rows.

The data driver 200 is configured to drive based on a control of the timing controller 400 and to output to the data lines DL a data voltage of a positive polarity or a negative polarity opposite to the positive polarity with respect to a reference voltage.

The gate driver 300 is configured to drive based on a control of the timing controller 400, and to sequentially output a gate signal to the gate lines GL.

The timing controller 400 is configured to receive a mode signal MDS, an image signal DATA and an input synchronization signal OSS from a graphic processor 700. The timing controller 400 is configured to generate an output synchronization signal based on the mode signal MDS for driving the display panel 100 with a corresponding mode. The mode signal MDS is an information signal which indicates a normal synchronization mode and a free synchronization mode. The image signal DATA may include red, green and blue data. The input synchronization signal OSS may include an input vertical synchronization signal, an input horizontal synchronization signal and an input data enable signal. The output synchronization signal PSS may include an output vertical synchronization signal, an output horizontal synchronization signal, an output data enable signal, and an inversion signal.

The timing controller 400 may include a normal synchronization processor 410 configured to process an output synchronization signal and an image signal in a normal synchronization mode and a free synchronization processor 420 configured to process an output synchronization signal and an image signal in a free synchronization mode. The normal synchronization processor 410 is configured to drive the display apparatus with the normal synchronization mode when the input frequency of the input synchronization signal is a normal frequency. The free synchronization processor 420 is configured to drive the display apparatus with the free synchronization mode when the input frequency of the input synchronization signal is freely varying in a preset frequency range. For example, the normal frequency of the normal synchronization mode may be 60 Hz. The preset frequency range of the free synchronization mode may be 25 Hz to 144 Hz. When the display apparatus has an Ultra High Definition (UHD) range of frame rates, for example, the preset frequency range may be 30 Hz to 704 Hz.

The normal synchronization processor 410 is configured to generate an output synchronization signal PSS which has a substantially same frequency as the normal frequency of the input synchronization signal, using the input synchronization signal received from the graphic processor 700. The normal synchronization processor 410 is configured to read out frame data in the memory 500 and to provide the data driver 200 with the frame data, based on the output synchronization signal PSS of the normal frequency. The normal synchronization processor 410 is configured to generate a data control signal DCS for controlling the data driver 200 and a gate control signal GCS for controlling the gate driver 300, based on the output synchronization signal PSS of the normal frequency.

The free synchronization processor 420 is configured to receive a plurality of input synchronization signals with a plurality of input frequencies and to generate an output synchronization signal with an output frequency which is substantially equal or similar to the preset frequency. The preset frequency may correspond to a maximum frequency of the preset frequency range.

The input synchronization signal includes a plurality of input frames respectively corresponding to the plurality of input frequencies. The plurality of input frames includes a plurality of active periods which are substantially the same as each other and a plurality of vertical blanking periods which are different from each other. An active period may correspond to an active period of the maximum frequency within the preset frequency range. For example, in a display apparatus with a Full High Definition (FHD) display panel, the input synchronization signal of the free synchronization mode may include the active period of 144 Hz being the maximum frequency of the preset frequency range. In a display apparatus with an Ultra High Definition (UHD) display panel, the input synchronization signal of the free synchronization mode may include the active period of 704 Hz being the maximum frequency of the preset frequency range.

The free synchronization processor 420 is configured to compensate different vertical blanking periods of different input frequencies using an inserting frame method and/or a shifting frame method and to generate an output synchronization signal which has a vertical blanking period being similar to a vertical blanking period of the preset frequency.

For example, in the free synchronization mode of the display apparatus with a FHD, the free synchronization processor 420 may be configured to generate a frame of 144 Hz without inserting a frame with respect to an input frame of 144 Hz. However, the free synchronization processor 420 may be configured to insert one frame in a vertical blanking period of an input frame with 60 Hz and to generate two frames corresponding to the input frame with 60 Hz. The free synchronization processor 420 may be configured to insert four frames in a vertical blanking period of an input frame with 25 Hz and to generate five frames corresponding to the input frame with 25 Hz.

The free synchronization processor 420 is configured to read out frame data in the memory 500 and to provide the data driver 200 with the frame data based on the output synchronization signal. The free synchronization processor 420 is configured to generate a data control signal DCS for controlling the data driver 200 and a gate control signal GCS for controlling the gate driver 300, based on the output synchronization signal PSS of the output frequency.

Figure 3:
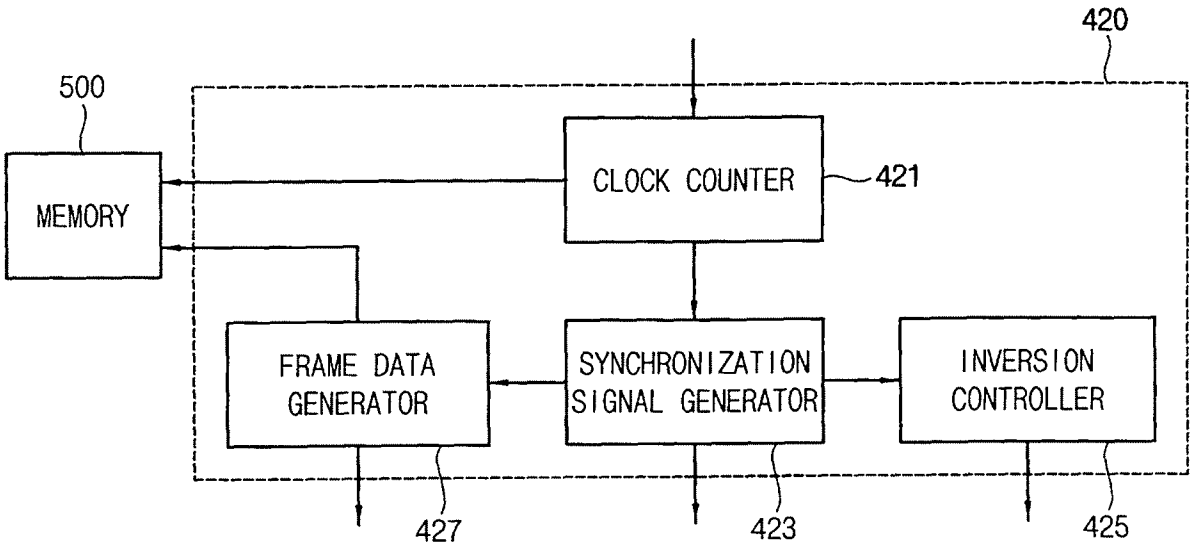
FIG. 3 is a block schematic diagram illustrating a free synchronization processor according to an exemplary embodiment.
Figure 4:
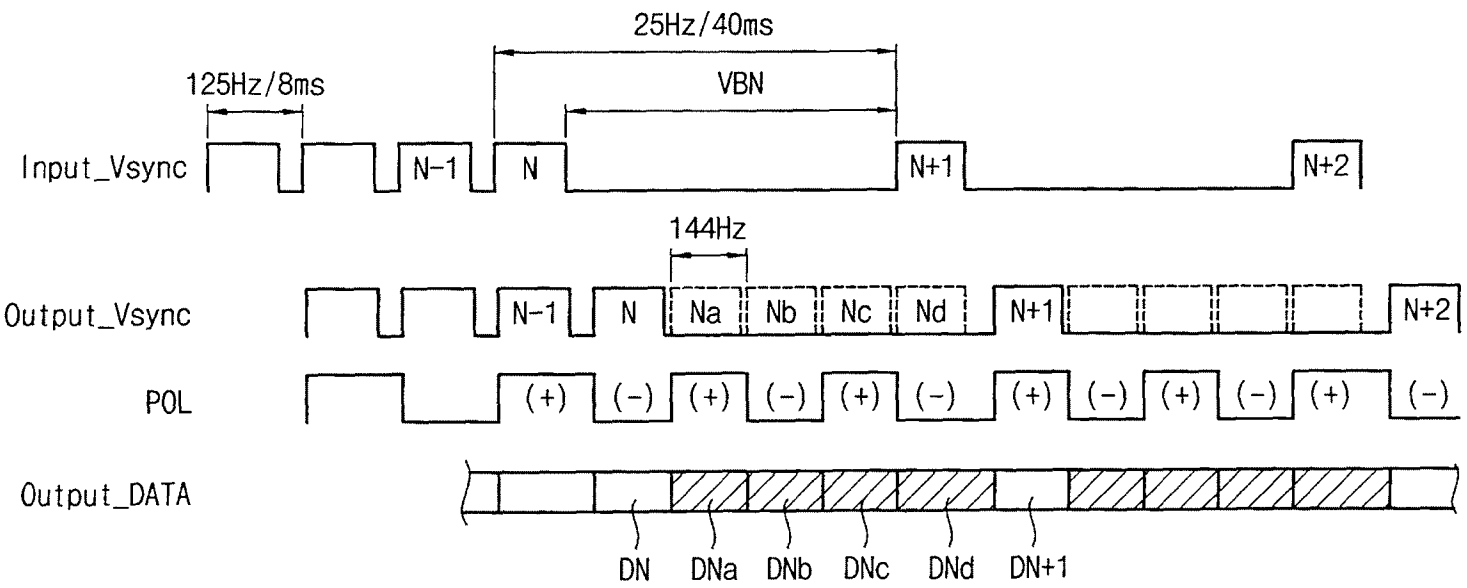
FIG. 4 is a waveform diagram illustrating input and output signals of a timing controller according to an exemplary embodiment.

FIG. 3 is a block diagram illustrating a free synchronization processor according to an exemplary embodiment. FIG. 4 is a waveform diagram illustrating input and output signals of a timing controller according to an exemplary embodiment.

Referring to FIGS. 3 and 4, the free synchronization processor 420 may include a clock counter 421, a synchronization signal generator 423 connected to the clock counter, an inversion controller 425 connected to the synchronization signal generator, and a frame data generator 427 connected to the synchronization signal generator.

The clock counter 421 is configured to count clock cycles of a current input frame based on input synchronization signals (e.g., an input vertical synchronization signal Input_Vsync and a clock signal). The clock counter 421 is configured to detect an input frequency of the current input frame based on the clock count of the current input frame.

When the vertical blanking period of the current input frame is longer than a frame with the preset frequency, the synchronization signal generator 423 is configured to insert a frame with the preset frequency in the vertical blanking period of the current input frame such that the output synchronization signal (e.g., an output vertical synchronization signal) is generated with an output frequency similar to the preset frequency.

However, when the vertical blanking period of the current input frame is shorter than a frame with the preset frequency, the synchronization signal generator 423 is configured to generate an output synchronization signal with the output frequency being substantially the same as the input frequency.

Referring to FIG. 4, the display apparatus may be referred to as a display apparatus with FHD and the preset frequency range of the input frequency may be referred to as 25 Hz to 144 Hz. When the input frequency of an (N−1)-th input frame is 125 Hz, the synchronization signal generator 423 is configured to generate an output vertical synchronization signal Output_Vsync of 125 Hz which is substantially the same as an input vertical synchronization signal Input_Vsync of 125 Hz. However, when the input frequency of an N-th input frame is 25 Hz, the synchronization signal generator 423 is configured to insert four frames with the preset frequency (e.g., 144 Hz) in the vertical blanking period VBN of 125 Hz and to generate an output vertical synchronization signal Output_Vsync of the output frequency being similar to the preset frequency (e.g., 144 Hz). The output vertical synchronization signal Output_Vsync may include first, second, third and fourth insertion frames Na, Nb, Nc and Nd.

The inversion controller 425 is configured to generate an inversion signal POL for controlling a polarity of a data voltage by a frame unit based on the output synchronization signal. Referring to FIG. 4, the inversion signal POL has a phase which swings between a low level and a high level based on the output vertical synchronization signal Output_Vsync. The inversion signal POL is applied to the data driver and controls the polarity of the data voltage outputted from the data driver by the frame unit.

The frame data generator 427 is configured to generate insertion frame data corresponding to an insertion frame based on the output synchronization signal. The frame data generator 427 is configured to generate the insertion frame data through a repeating method (e.g., Doubling method), or a Motion Estimation Motion Compensation (MEMC) method. The repeating method may repeat frame data of a previous input frame and then generate repetition frame data as the insertion frame data. The MEMC method may estimate and compensate motion using current input frame data and previous (or next) input frame data and then generate interpolation frame data as the insertion frame data.

Referring to FIG. 4, the frame data generator 427 is configured to output the insertion frame data DNa, DNb, DNc and DNd respectively corresponding to the insertion frames Na, Nb, Nc and Nd of the output vertical synchronization signal Output_Vsync (Output_DATA). Herein, the insertion frame data DNa, DNb, DNc and DNd are generated using the N-th frame data DN through the repeating method.

According to an exemplary embodiment, in the free synchronization mode, different vertical blanking periods in the input synchronization signal may compensate through a frame insertion method and thus, the output synchronization signal including similar vertical blanking periods may be generated. Thus, display defects such as a tearing defect and a stuttering defect may be substantially avoided. In addition, the inversion signal is generated based on the output synchronization signal including similar vertical blanking periods and thus an unequal distribution of a polarity between adjacent frames may be decreased and a DC afterimage may be decreased.

Figure 5:
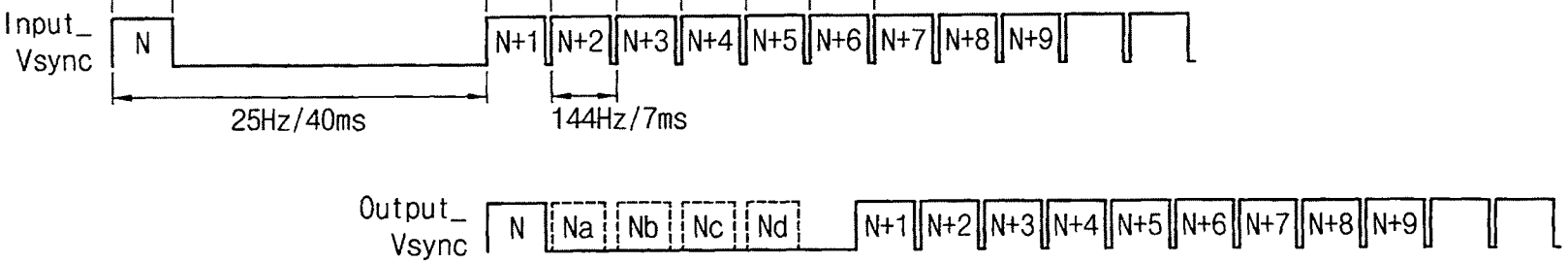
FIG. 5 is a waveform diagram illustrating input and output signals of a timing controller according to an exemplary embodiment.
Figure 7:
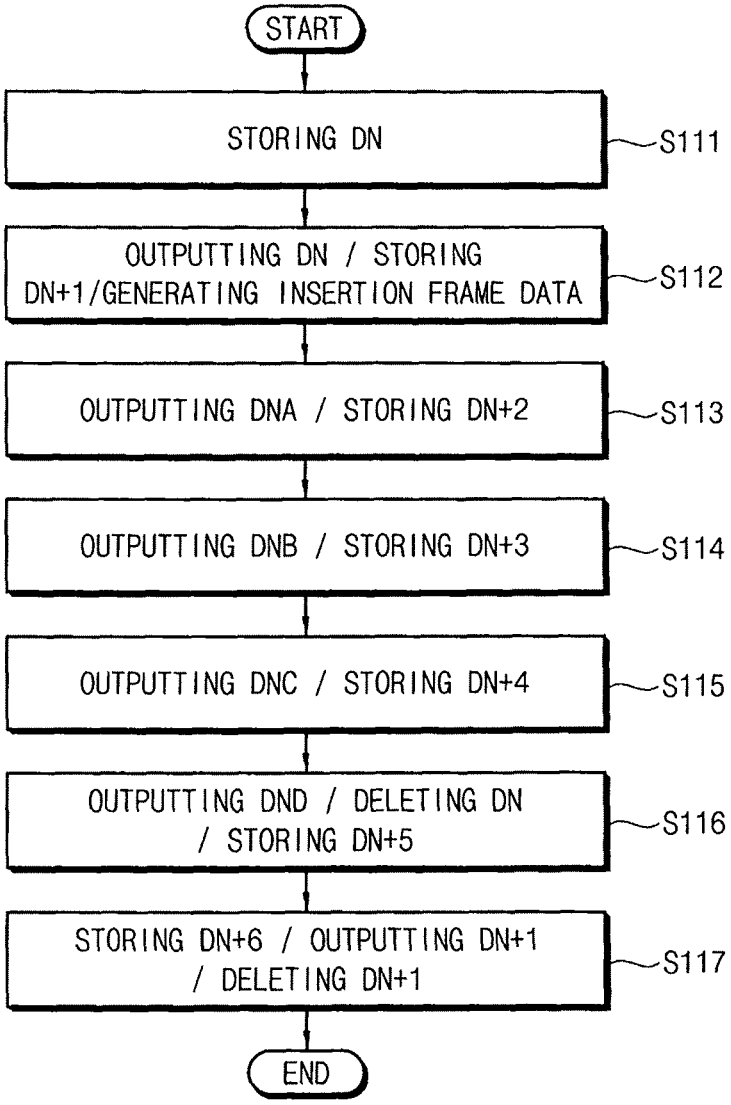
FIG. 7 is a flowchart diagram illustrating a method of driving the memory according to the timing controller of FIG. 1 in correspondence with the waveform diagram in FIG. 5.

FIG. 5 is a waveform diagram illustrating input and output signals of a timing controller according to an exemplary embodiment. FIG. 6 is a diagram illustrating a memory according to the timing controller in FIG. 5. FIG. 7 is a flowchart illustrating a method of driving the memory according to the timing controller in FIG. 5.

Referring to FIGS. 3, 5, 6 and 7, when the input frequency of the display apparatus with the FHD changes to 25 Hz from 144 Hz in the free synchronization mode, a method of driving a memory is explained. The memory may include a plurality of frame buffers.

The input frequency of an input vertical synchronization signal Input_Vsync is 25 Hz during an N-th frame N and changes to 144 Hz for an (N+1)-th frame N+1.

N-th frame data DN are written in a first frame buffer FB1 during a first period t1 of the input vertical synchronization signal Input_Vsync corresponding to an N-th frame. The clock counter 421 is configured to detect an input frequency of the N-th input frame N during the first period t1. The synchronization signal generator 423 is configured to insert four frames Na, Nb, Nc and Nd in a vertical blanking period of the N-th frame N and to generate an output vertical synchronization signal Output_Vsync (Step S111). Each of four frames Na, Nb, Nc and Nd corresponds to a frame with the preset frequency (e.g., 144 Hz).

During a second period t2 which corresponds to an (N+1)-th frame N+1 of the input vertical synchronization signal Input_Vsync, (N+1)-th frame data DN+1 are written in a second frame buffer FB2, and the N-th frame data DN are read out in synchronization with the output vertical synchronization signal Output_Vsync. During the second period t2, the frame data generator 427 is configured to repeat the N-th frame data through the repeating method (doubling method) to generate the insertion frame data. Alternatively, the frame data generator 427 is configured to generate interpolation frame data as the insertion frame data using the N-th and (N+1)-th frame data through the MEMC method (Step S112). For example, when the insertion frame data DNa, DNb, DNc and DNd are generated through the repeating method, the insertion frame data DNa, DNb, DNc and DNd may be the same as the N-th frame data DN. When the insertion frame data DNa, DNb, DNc and DNd are generated through the MEMC method, the insertion frame data DNa, DNb, DNc and DNd are the same as the interpolation frame data which are generated using the N-th frame data DN and the (N+1)-th frame data DN+1.

During a third period t3 which corresponds to an (N+2)-th frame of the input vertical synchronization signal Input_Vsync, (N+2)-th frame data DN+2 are written in a third frame buffer FB3 and the first insertion frame data DNa are read out in synchronization with the output vertical synchronization signal Output_Vsync (Step S113).

During a fourth period t4 which corresponds to an (N+3)-th frame N+3 of the input vertical synchronization signal Input_Vsync, (N+3)-th frame data DN+3 are written in a fourth frame buffer FB4 and second insertion frame data DNb are read out in synchronization with the output vertical synchronization signal Output_Vsync (Step S114).

During a fifth period t5 which corresponds to an (N+4)-th frame N+4 of the input vertical synchronization signal Input_Vsync, (N+4)-th frame data DN+4 are written in a fifth frame buffer FB5 and third insertion frame data DNc are read out in synchronization with the output vertical synchronization signal Output_Vsync (Step S115).

During a sixth period t6 which corresponds to an (N+5)-th frame N+5 of the input vertical synchronization signal Input_Vsync, record of the first frame buffer FB1 is deleted, (N+5)-th frame data DN+5 are written in the first frame buffer FB1, and fourth insertion frame data DNd are read out in synchronization with the output vertical synchronization signal Output_Vsync (Step S116).

During a seventh period t7 which corresponds to an (N+6)-th frame N+6 of the input vertical synchronization signal Input_Vsync, (N+6)-th frame data DN+6 are written in a sixth frame buffer FB6, the (N+1)-th frame data DN+1 in the second frame buffer FB2 are read out and record of the second frame buffer FB2 is deleted (Step S117).

According to the exemplary embodiment, a number of the insertion frame and a number of the frame buffer may be determined by a length of the vertical blanking period of the input frame.

According to the exemplary embodiment, in the free synchronization mode, different vertical blanking periods in the input synchronization signal may compensate through a frame insertion method and thus, the output synchronization signal including similar vertical blanking periods may be generated. Thus, display defects such as a tearing defect and a stuttering defect may be substantially minimized. In addition, the inversion signal is generated based on the output synchronization signal including similar vertical blanking periods and thus an unequal distribution of polarity between adjacent frames may be substantially minimized and a DC afterimage may be substantially minimized.

Figure 8:
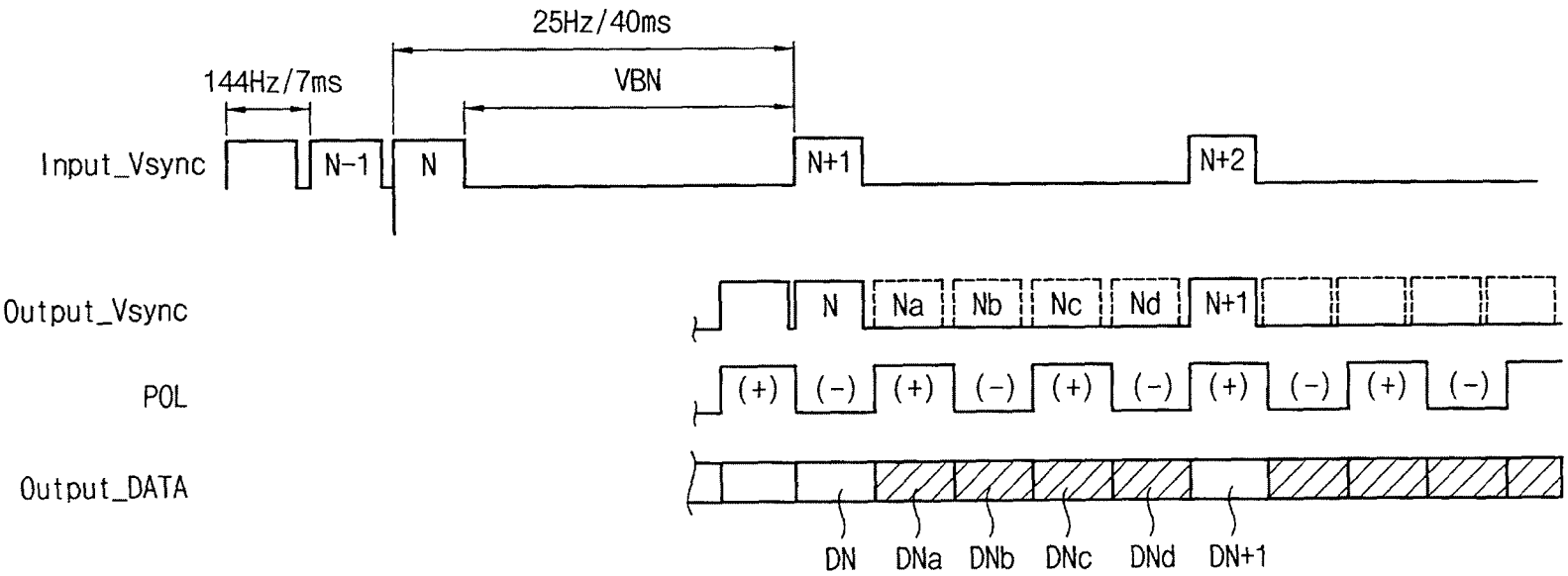
FIG. 8 is a waveform diagram illustrating input and output signals of a timing controller according to an exemplary embodiment.

FIG. 8 is a waveform diagram illustrating input and output signals of a timing controller according to an exemplary embodiment.

Referring to FIGS. 3 and 8, a method of inserting a frame according to the display apparatus with the FHD is explained in the free synchronization mode.

The clock counter 421 is configured to count a clock count of a current input frame based on input synchronization signals (e.g., an input vertical synchronization signal Input_Vsync) and a clock signal. An input frequency of the current input frame may be detected by the clock count of the current input frame.

When a vertical blanking period of the current input frame is longer than a frame of a preset frequency, the synchronization signal generator 423 is configured to uniformly divide the vertical blanking period of the current input frame into the frame with the preset frequency, to uniformly insert an insertion frame in the divided vertical blanking period corresponding to the frame with the preset frequency, and to generate an output synchronization signal (e.g., an output vertical synchronization signal) with an output frequency being similar to the preset frequency.

However, when the vertical blanking period of the current input frame is shorter than the frame with the preset frequency, the synchronization signal generator 423 is configured to generate the output synchronization signal (e.g., the output vertical synchronization signal) with an output frequency being substantially the same as the input frequency.

Referring to FIG. 8, when the input frequency of an (N−1)-th input frame is the preset frequency of 144 Hz, the synchronization signal generator 423 is configured to generate an output vertical synchronization signal Output_Vsync which is substantially the same as an input vertical synchronization signal Input_Vsync of 144 Hz. However, when the input frequency of an N-th input frame is 25 Hz, the synchronization signal generator 423 is configured to uniformly divide the vertical blanking period of 25 Hz into the frame with the preset frequency (e.g., 144 Hz), to uniformly insert four insertion frames Na, Nb, Nc and Nd in the divided vertical blanking period corresponding to the frame with the preset frequency, and to generate an output vertical synchronization signal Output_Vsync with an output frequency being similar to the preset frequency.

The inversion controller 425 is configured to generate an inversion signal POL based on the output vertical synchronization signal Output_Vsync to control a polarity of a data voltage per frame unit. Referring to FIG. 8, the inversion signal POL has a phase which swings between a low level and a high level based on the output vertical synchronization signal Output_Vsync. The inversion signal POL is applied to the data driver and controls the polarity of the data voltage outputted from the data driver to reverse the polarity of the data voltage per frame unit.

The frame data generator 427 is configured to generate insertion frame data corresponding to an insertion frame based on the output synchronization signal. The frame data generator 427 is configured to generate the insertion frame data through a repeating method (Doubling method), or an MEMC (Motion Estimation Motion Compensation) method. The repeating method may repeat frame data of a previous input frame and then generate repetition frame data as the insertion frame data. The MEMC method may estimate and compensate motion using current input frame data and previous or next frame data and then generate interpolation frame data as the insertion frame data.

Referring to FIG. 8, the frame data generator 427 is configured to output the insertion frame data DNa, DNb, DNc and DNd respectively corresponding to the insertion frames of the output vertical synchronization signal Output_Vsync.

According to the exemplary embodiment, the insertion frame is inserted at a substantially equal interval in the vertical blanking period of the input frame. Thus, display defects such as a tearing defect and a stuttering defect may be substantially minimized. In addition, the inversion signal is generated based on the output synchronization signal and thus an unequal distribution of a polarity between adjacent frames may be substantially minimized and a DC afterimage may be substantially minimized.

Figure 9:
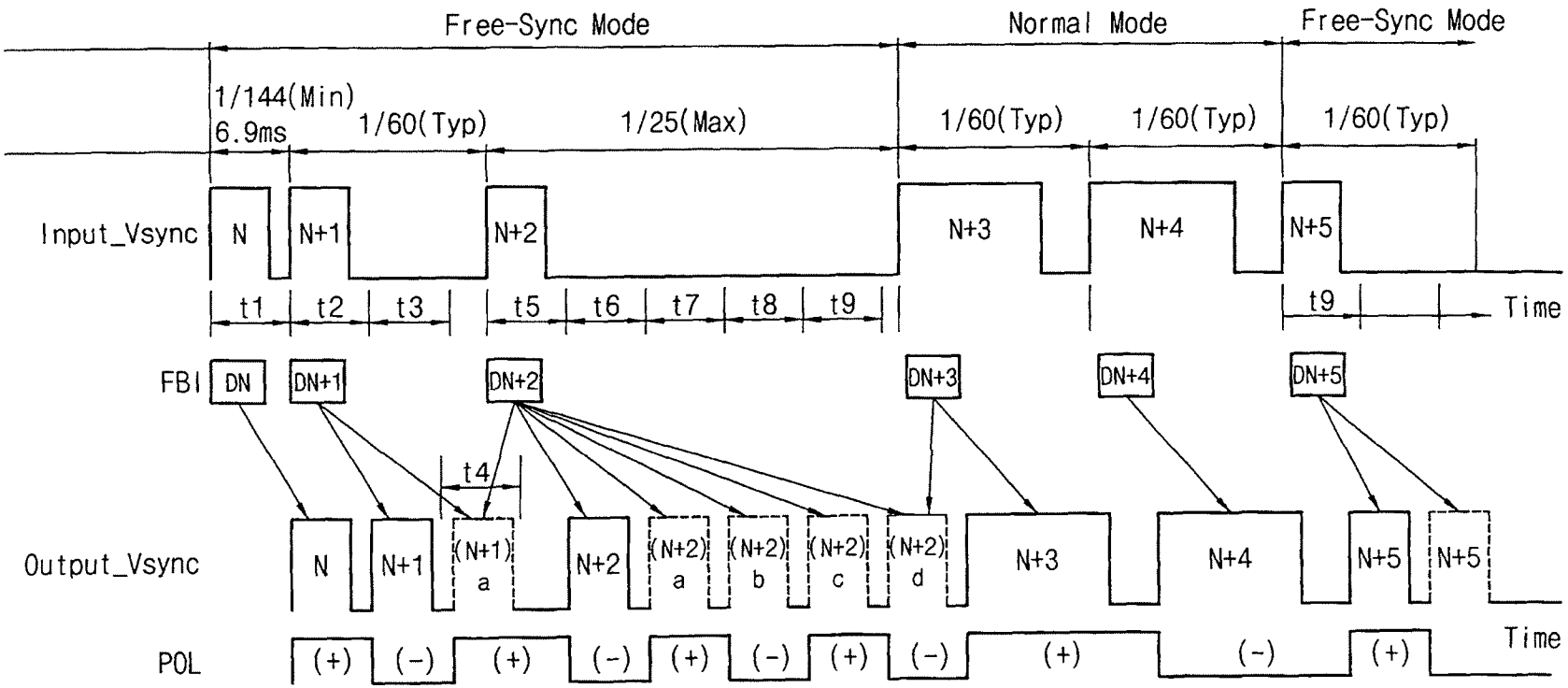
FIG. 9 is a hybrid diagram illustrating a method of driving a display apparatus according to an exemplary embodiment.

FIG. 9 is a diagram illustrating a method of driving a display apparatus according to an exemplary embodiment. Referring to FIG. 9, a memory according to an exemplary embodiment may include a single frame buffer.

Referring to FIGS. 2, 3 and 9, a method of inserting a frame according to the display apparatus with the FHD is explained using the single frame buffer in the free synchronization mode.

During a first period t1, the clock counter 421 is configured to receive an input vertical synchronization signal Input_Sync and a clock signal, and to count a clock count of an N-th input frame based on the input vertical synchronization signal Input_Vsync and the clock signal. N-th frame data DN are written in the single frame buffer FB1. The input frequency of the N-th input frame may be referred to as 144 Hz.

The synchronization signal generator 423 is configured to generate an output vertical synchronization signal Output_Vsync of the N-th frame based on the clock count of the N-th input frame and the preset frequency of 144 Hz.

The output vertical synchronization signal Output_Vsync may be delayed by a preset frame from the input vertical synchronization signal Input_Vsync. The preset frame may be equal to a frame period (e.g., 6.9 ms) of the preset frequency (e.g., 144 Hz).

During a second period t2, the clock counter 421 is configured to count a clock count of the (N+1)-th input frame based on the input vertical synchronization signal Input_Vsync and the clock signal. The input frequency of the (N+1)-th input frame may be referred to as 60 Hz.

The frame data generator 427 reads out the N-th frame data DN in the single frame buffer FB1 during an N-th frame of the output vertical synchronization signal Output_Vsync. The N-th frame data DN in the single frame buffer FB1 are deleted and (N+1)-th frame data DN+1 are written in the single frame buffer FB1.

During a third period t3, the synchronization signal generator 423 generates an output vertical synchronization signal Output_Vsync of the (N+1)-th frame based on the clock count of the (N+1)-th input frame and the preset frequency (e.g., 144 Hz) of the free synchronization mode. The frame data generator 427 is configured to read out the (N+1)-th frame data DN+1 in the single frame buffer FB1 during the (N+1)-th frame of the output vertical synchronization signal Output_Vsync.

During a fourth period t4, the synchronization signal generator 423 is configured to generate an insertion frame (N+1)a of the output vertical synchronization signal Output_Vsync based on the clock count and the preset frequency of 144 Hz. The frame data generator 427 is configured to read out the (N+1)-th frame data DN+1 as the insertion frame data in the single frame buffer FB1 during the insertion frame (N+1)a of the output vertical synchronization signal Output_Vsync.

For the fourth period t4, the synchronization signal generator 423 is configured to not insert the insertion frame in a remaining period of the (N+1)-th frame based on the clock count of the (N+1)-th input frame and the preset frequency of 144 Hz. The remaining period of the (N+1)-th frame for the fourth period t4 is shorter than the preset frame (e.g., 6.9 ms).

During a fifth period t5, the synchronization signal generator 423 is configured to generate the output vertical synchronization signal Output_Vsync of an (N+2)-th frame based on the clock count of the (N+2)-th input frame and the preset frequency (e.g., 144 Hz) of the free synchronization mode. The input frequency of the (N+2)-th input frame may be referred to as 25 Hz. The single frame buffer FB1 stores (N+2)-th frame data DN+2.

During a sixth period t6, the synchronization signal generator 423 is configured to generate the output vertical synchronization signal Output_Vsync of a first insertion frame (N+2)a based on the clock count of the (N+2)-th input frame and the preset frequency (e.g., 144 Hz). The frame data generator 427 is configured to read out the (N+2)-th frame data DN+2 as the insertion frame data in the single frame buffer FB1, during the (N+2)-th frame of the output vertical synchronization signal Output_Vsync.

During a seventh period t7, the synchronization signal generator 423 is configured to generate a second insertion frame (N+2)b of the output vertical synchronization signal Output_Vsync based on the clock count of the (N+2)-th input frame and the preset frequency (e.g., 144 Hz). The frame data generator 427 is configured to read out the (N+2)-th frame data DN+2 as the insertion frame data in the single frame buffer FB1, during the first insertion frame (N+2)a of the output vertical synchronization signal Output_Vsync.

During an eighth period t8, the synchronization signal generator 423 is configured to generate a third insertion frame (N+2)c of the output vertical synchronization signal Output_Vsync based on the clock count of the (N+2)-th input frame and the preset frequency (e.g., 144 Hz). The frame data generator 427 is configured to read out the (N+2)-th frame data DN+2 as the insertion frame data in the single frame buffer FB1, during the second insertion frame (N+2)b of the output vertical synchronization signal Output_Vsync.

During a ninth period t9, the synchronization signal generator 423 is configured to generate a fourth insertion frame (N+2)d of the output vertical synchronization signal Output_Vsync based on the clock count of the (N+2)-th input frame and the preset frequency (e.g., 144 Hz). The frame data generator 427 is configured to read out the (N+2)-th frame data DN+2 as the insertion frame data in the single frame buffer FB1, during the third insertion frame (N+2)c of the output vertical synchronization signal Output_Vsync.

For the ninth period t9, the synchronization signal generator 423 is configured to not insert the insertion frame in a remaining period of the (N+2)-th frame based on the clock count of the (N+2)-th input frame and the preset frequency of 144 Hz. The remaining period of the (N+2)-th frame for the ninth period t9 is shorter than the preset frame (e.g., 6.9 ms).

The inversion controller 425 is configured to generate an inversion signal POL based on the output vertical synchronization signal Output_Vsync to control a polarity of a data voltage per frame unit.

According to the exemplary embodiment, the insertion frame data corresponding to the insertion frames may be generated through the single frame buffer.

According to the exemplary embodiment, in the free synchronization mode, different vertical blanking periods in the input synchronization signal may compensate through a frame insertion method and thus, the output synchronization signal including similar vertical blanking periods may be generated. Thus, display defects such as a tearing defect and a stuttering defect may be substantially minimized. In addition, the inversion signal is generated based on the output synchronization signal including similar vertical blanking periods and thus an unequal distribution of a polarity between adjacent frames may be substantially minimized and a DC afterimage may be substantially minimized.

Figure 10:
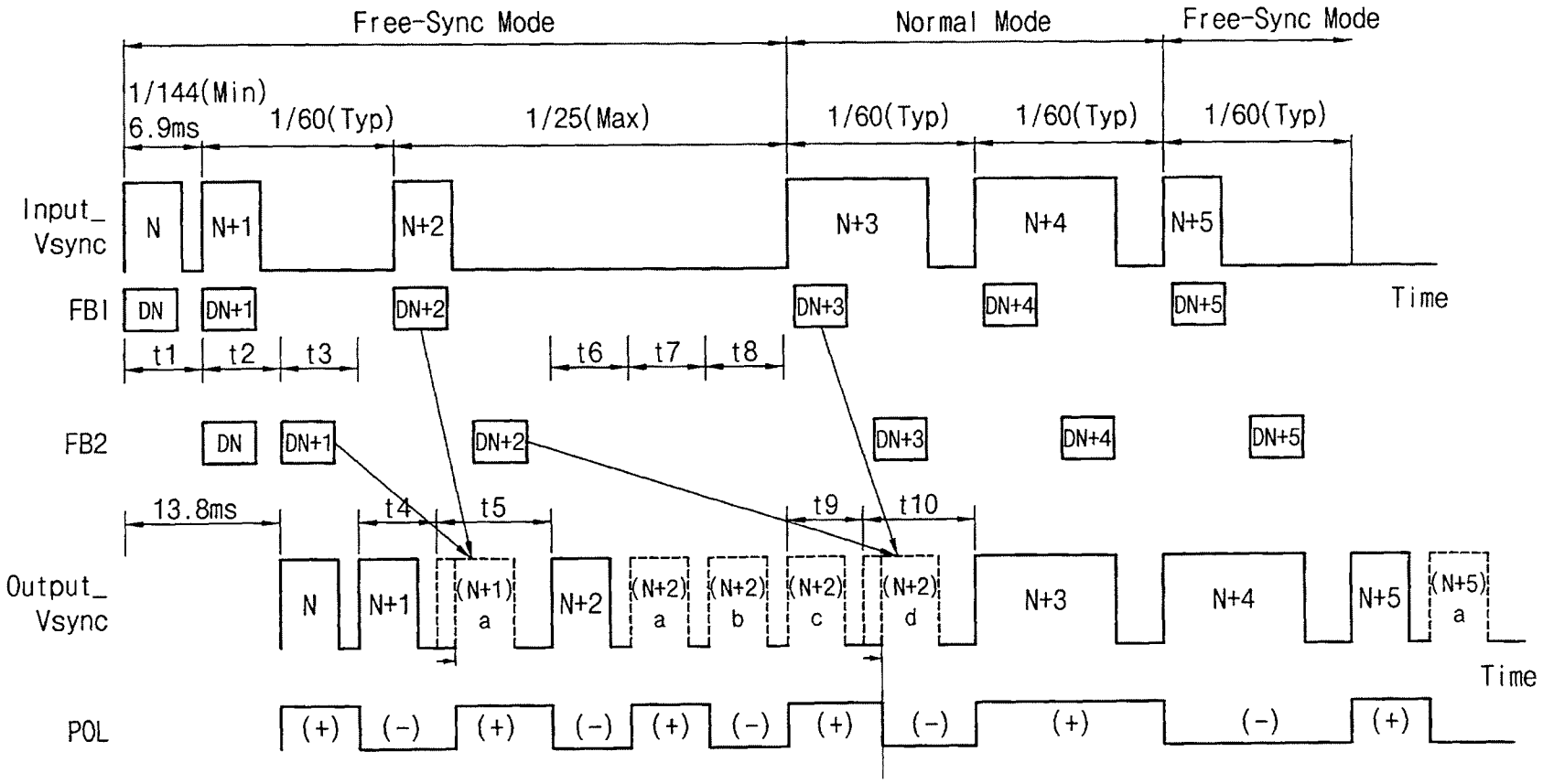
FIG. 10 is a hybrid diagram illustrating a method of driving a display apparatus according to an exemplary embodiment.

FIG. 10 is a diagram illustrating a method of driving a display apparatus according to an exemplary embodiment.

Referring to FIG. 10, according to the exemplary embodiment, the display apparatus is configured to perform an inserting frame method and a shifting frame method using dual frame buffers which include a first frame buffer FB1 and a second frame buffer FB2 in the free synchronization mode.

Referring to FIGS. 2, 3 and 10, a method of driving a free synchronization processor according to the display apparatus with the FHD is explained using the dual frame buffers in the free synchronization mode.

During a first period t1, the clock counter 421 is configured to receive an input vertical synchronization signal Input_Sync and a clock signal and to count a clock count of an N-th input frame based on the input vertical synchronization signal Input_Vsync and the clock signal. N-th frame data DN are written in the single frame buffer FB1. The input frequency of the N-th input frame may be referred to as 144 Hz.

During a second period t2, the clock counter 421 is configured to count a clock count of an (N+1)-th input frame based on an input vertical synchronization signal Input_Vsync and a clock signal. The input frequency of the (N+1)-th input frame may be referred to as 60 Hz. (N+1)-th frame data DN+1 are written in the first frame buffer FB1 and the N-th frame data DN are written in the second frame buffer FB2. The synchronization signal generator 423 is generated for an output vertical synchronization signal Output_Vsync of the N-th frame based on the clock count and the preset frequency (e.g., 144 Hz).

The output vertical synchronization signal Output_Vsync may be delayed by twice the preset frame from the input vertical synchronization signal Input_Vsync. The preset frame may be equal to a frame period (e.g., 6.9 ms) of the preset frequency (e.g., 144 Hz).

During a third period t3, the frame data generator 427 is configured to read out the N-th frame data DN which are written in the second frame buffer FB2, during the N-th frame of the output vertical synchronization signal Output_Vsync. The (N+1)-th frame data DN+1 are written in the second frame buffer FB2 and the (N+1)-th frame data DN+1 in the first frame buffer FB1 are deleted.

During a fourth period t4, the synchronization signal generator 423 is generated for an output vertical synchronization signal Output_Vsync of an (N+1)-th frame based on the clock count of the (N+1)-th input frame and the preset frequency (e.g., 144 Hz) of the free synchronization mode.

The frame data generator 427 is configured to read out the (N+1)-th frame data DN+1 in the second frame buffer FB2, during the (N+1)-th frame of the output vertical synchronization signal Output_Vsync.

An (N+2)-th input frame of the input synchronization signal is received during a partial period of the fourth period t4. The clock counter 421 is configured to count a clock count of an (N+2)-th input frame. (N+2)-th frame data DN+2 are written in the first frame buffer FB1.

During a fifth period t5, the synchronization signal generator 423 is configured to generate an insertion frame (N+1)a of the output vertical synchronization signal Output_Vsync based on the clock count of the (N+1)-th input frame. The synchronization signal generator 423 is configured to count a clock count of a vertical blanking period in the (N+1)-th input frame based on reception of the (N+2)-th input frame and then, to generate an output vertical synchronization signal Output_Vsync using the clock count of vertical blanking period in the (N+1)-th input frame such that a vertical blanking period of the (N+1)-th frame is substantially the same as a vertical blanking period of the insertion frame (N+1)a in the output vertical synchronization signal Output_Vsyn.

The frame data generator 427 is configured to generate insertion frame data using the (N+2)-th frame data DN+2 in the first frame buffer FB1 and the (N+1)-th frame data in the second frame buffer FB2, through an MEMC method. The frame data generator 427 is configured to output the insertion frame data during the insertion frame (N+1)a of the output vertical synchronization signal Output_Vsync.

The (N+2)-th frame data DN+2 are written in the second frame buffer FB2, and the (N+2)-th frame data DN+2 in the first frame buffer FB1 are deleted.

During a sixth period t6, the synchronization signal generator 423 is configured to generate the output vertical synchronization signal Output_Vsync of an (N+2)-th frame based on the clock count of the (N+2)-th input frame and the preset frequency (e.g., 144 Hz) of the free synchronization mode. The frame data generator 427 is configured to read out the (N+2)-th frame data DN+2 in the second frame buffer FB2 during the (N+2)-th frame of the output vertical synchronization signal Output_Vsync.

During a seventh period t7, the synchronization signal generator 423 is configured to generate a first insertion frame (N+2)a of the output vertical synchronization signal Output_Vsync based on the clock count of the (N+2)-th input frame and the preset frequency (e.g., 144 Hz) of the free synchronization mode. The frame data generator 427 is configured to read out the (N+2)-th frame data DN+2 in the second frame buffer FB2 during the first insertion frame (N+2)a of the output vertical synchronization signal Output_Vsync.

During an eighth period t8, the synchronization signal generator 423 is configured to generate a second insertion frame (N+2)b of the output vertical synchronization signal Output_Vsync based on the clock count of the (N+2)-th input frame and the preset frequency (e.g., 144 Hz) of the free synchronization mode. The frame data generator 427 is configured to read out the (N+2)-th frame data DN+2 in the second frame buffer FB2 during the second insertion frame (N+2)b of the output vertical synchronization signal Output_Vsync.

During a ninth period t9, the synchronization signal generator 423 is configured to generate a third insertion frame (N+2)c of the output vertical synchronization signal Output_Vsync based on the clock count of the (N+2)-th input frame and the preset frequency (e.g., 144 Hz) of the free synchronization mode. The frame data generator 427 is configured to read out the (N+2)-th frame data DN+2 in the second frame buffer FB2 during the third insertion frame N+2c of the output vertical synchronization signal Output_Vsync.

The (N+3)-th input frame of the input synchronization signal Input_Vsync are received during a partial period of the ninth period t9. The clock counter 421 is configured to count a clock count of the (N+3)-th input frame. The (N+3)-th frame data DN+3 are written in the first frame buffer FB1.

During a tenth period t10, the synchronization signal generator 423 is configured to generate a fourth insertion frame (N+2)d of the output vertical synchronization signal Output_Vsync based on the clock count of the (N+2)-th input frame. The synchronization signal generator 423 is configured to count a clock count of a vertical blanking period in the (N+2)-th input frame based on reception of the (N+3)-th input frame and then, to generate an output vertical synchronization signal Output_Vsync using the clock count of vertical blanking period in the (N+2)-th input frame such that a vertical blanking period in the third insertion frame (N+2)c of the output vertical synchronization signal Output_Vsync is substantially the same as a vertical blanking period in the fourth insertion frame (N+2)d of the output vertical synchronization signal Output_Vsync.

The frame data generator 427 is configured to generate insertion frame data using the (N+3)-th frame data DN+3 in the first frame buffer FB1 and the (N+2)-th frame data DN+2 in the second frame buffer FB2, through an MEMC method. The frame data generator 427 is configured to output the insertion frame data during the fourth insertion frame (N+2)d of the output vertical synchronization signal Output_Vsync.

The (N+3)-th frame data DN+3 are written in the second frame buffer FB2 and the (N+3)-th frame data DN+3 in the first frame buffer FB1 are deleted.

The inversion controller 425 is configured to generate an inversion signal POL based on the output vertical synchronization signal Output_Vsync to control polarity of a data voltage per frame unit.

According to the exemplary embodiment, the inserting frame method and the shifting frame method may be performed through dual frame buffers.

According to the exemplary embodiment, in the free synchronization mode, different vertical blanking periods in the input synchronization signal may compensate through a frame insertion method and thus, the output synchronization signal including similar vertical blanking periods may be generated. Thus, display defects such as a tearing defect and a stuttering defect may be substantially minimized. In addition, the inversion signal is generated based on the output synchronization signal including similar vertical blanking periods and thus an unequal distribution of a polarity between adjacent frames may be substantially minimized and a DC afterimage may be substantially minimized.

Figure 11:
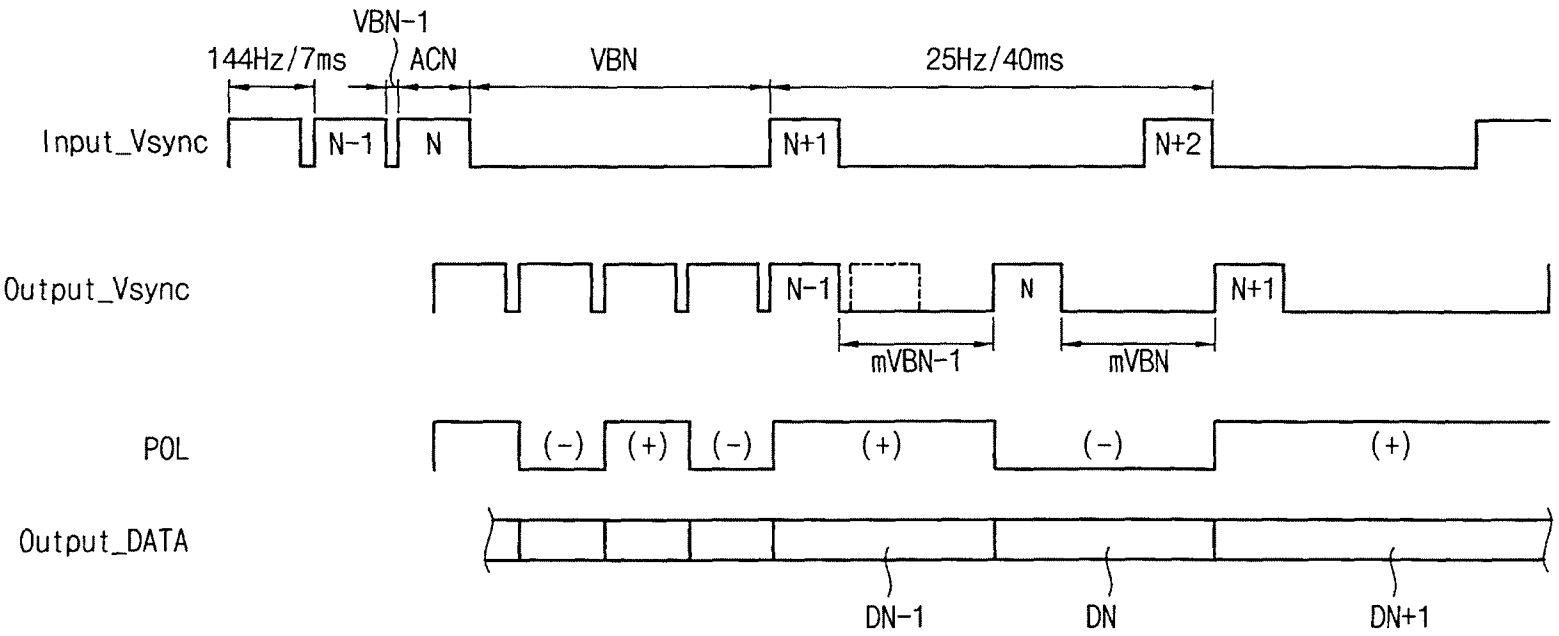
FIG. 11 is a waveform diagram illustrating input and output signals of a timing controller according to an exemplary embodiment.

FIG. 11 is a waveform diagram illustrating input and output signals of a timing controller according to an exemplary embodiment.

Referring to FIGS. 3 and 11, the display apparatus may be referred to as a display apparatus with a FHD and the preset frequency range of the input frequency may be referred to as 25 Hz to 144 Hz.

The clock counter 421 is configured to detect input frequencies of a current input frame and a previous input frame based on the input synchronization signal (e.g., an input vertical synchronization signal Input_Vsync) and the clock signal. The input frequency may be detected by a clock count in a frame.

The clock counter 421 is configured to detect an input frequency of the current input frame and an input frequency of the previous input frame.

When the input frequency of the current input frame is changed from the input frequency of a previous input frame, the synchronization signal generator 423 is configured to adjust a vertical blanking period of the current input frame and a vertical blanking period of the previous input frame to be the same as each other, and to generate an output synchronization signal (e.g., an output vertical synchronization signal). The vertical blanking period of the current frame is the same as the vertical blanking period of the previous frame in the output vertical synchronization signal.

For example, when the input frequency of the current input frame is lower than the input frequency of the previous input frame, an active period of the current frame is shifted toward a next frame in the output vertical synchronization signal. When the input frequency in the current input frame of output vertical synchronization signal is higher than the input frequency of the previous input frame, the active period of the current frame is shifted toward the previous frame in the output vertical synchronization signal.

Referring to FIG. 11, the input frequency of an (N−1)-th input frame which is the previous input frame is referred to as 144 Hz, and the input frequency of an N-th input frame which is the current input frame is referred to as 25 Hz. The synchronization signal generator 523 is configured to shift an active period ACN of the N-th frame toward the (N+1)-th frame in an output vertical synchronization signal Output_Vsync such that a clock count corresponding to the vertical blanking period VBN of the N-th frame is substantially the same as an average clock count of the vertical blanking period VBN-1 of the (N−1)-th frame and the vertical blanking period VBN of the N-th frame in the output vertical synchronization signal Output_Vsync. Thus, the synchronization signal generator 523 is configured to generate the output vertical synchronization signal Output_Vsync including the active period ACN of the N-th frame shifted toward the (N+1)-th frame with respect to the input vertical synchronization signal Input_Vsync.

Therefore, the output vertical synchronization signal Output_Vsync includes a vertical blanking period mVBN-1 of the (N−1)-th frame and a vertical blanking period mVBN of the N-th frame being substantially the same as the vertical blanking period mVBN-1 of the (N−1)-th frame.

Figure 12:
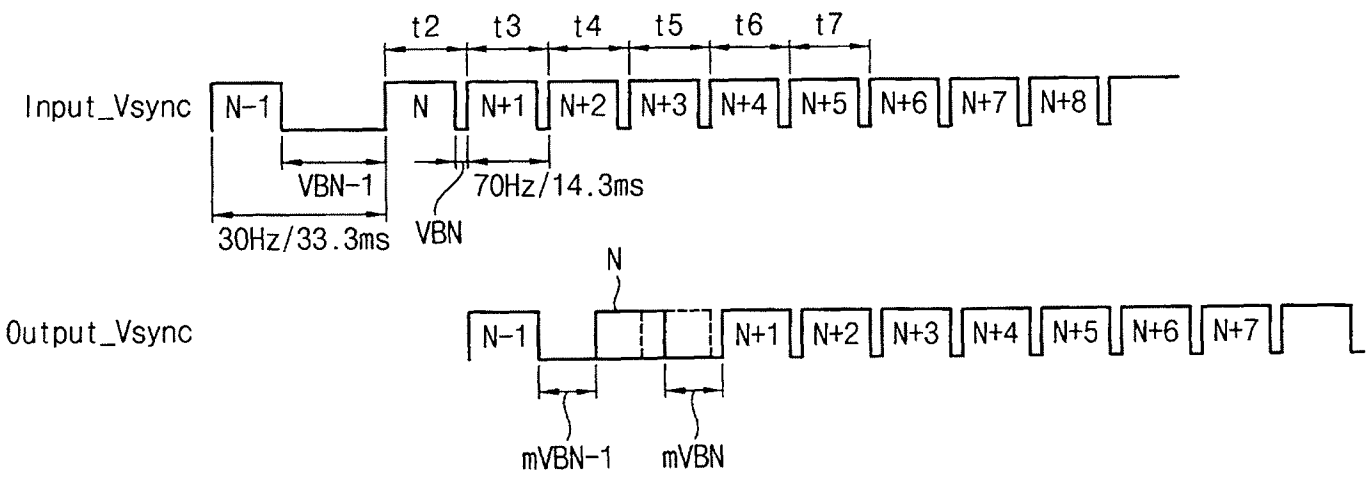
FIG. 12 is a waveform diagram illustrating input and output signals of a timing controller according to an exemplary embodiment.

The inversion controller 425 is configured to generate an inversion signal POL for controlling a polarity of a data voltage per frame unit based on the output synchronization signal. Referring to FIG. 12, the inversion signal POL has a phase which swings between a low level and a high level based on the output vertical synchronization signal Output_Vsync.

As shown in FIG. 11, lengths of the (N−1)-th and N-th frames in the inversion signal POL are substantially equal to each other and thus, an unequal distribution of a polarity between adjacent frames may be substantially minimized and a DC afterimage may be substantially minimized.

The frame data generator 427 is configured to read out corresponding frame data in the memory 500 based on the output vertical synchronization signal Output_Vsync including the shifted N-th frame.

Referring to FIG. 11, the frame data generator 427 is configured to read out (N−1)-th frame data DN−1 which are written in the memory 500 during the (N−1)-th frame of the output vertical synchronization signal Output_Vsync and then, to read out N-th frame data DN which are written in the memory 500 during the N-th frame of the output vertical synchronization signal Output_Vsync (Output_DATA).

According to the exemplary embodiment, length difference between adjacent frames in the output synchronization signal according to different input frequencies is compensated by the shifting frame method, and thus display defects such as a tearing defect and a stuttering defect may be substantially minimized. In addition, the inversion signal is generated based on the output synchronization signal and thus an unequal distribution of a polarity between adjacent frames may be substantially minimized and DC afterimage may be substantially minimized.

Figure 14:
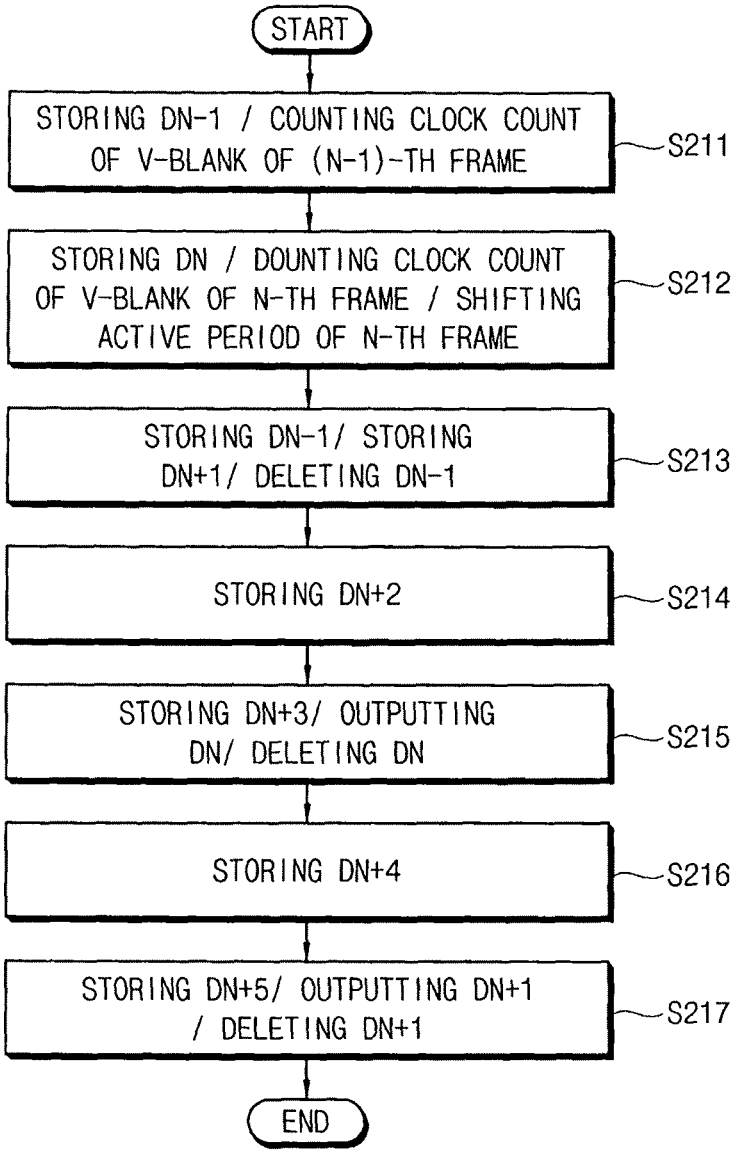
FIG. 14 is a flowchart diagram illustrating a method of driving the memory according to the timing controller in FIG. 12.

FIG. 12 is a waveform diagram illustrating input and output signals of a timing controller according to an exemplary embodiment. FIG. 13 is a diagram illustrating a memory according to the timing controller in FIG. 12. FIG. 14 is a flowchart illustrating a method of driving the memory according to the timing controller in FIG. 12.

Referring to FIGS. 3, 12, 13 and 14, the display apparatus may be referred to as a display apparatus with an UHD and the preset frequency range of the input frequency may be referred to as 30 Hz to 704 Hz.

When an input frequency of an input synchronization signal (e.g., an input vertical synchronization signal Input_Vsync) changes from 30 Hz to 70 Hz, a method of driving a memory is explained. The memory may include a plurality of frame buffers.

The input vertical synchronization signal Input_Vsync has the input frequency of 30 Hz in an (N−1)-th input frame and has the input frequency changed to 70 Hz in an N-th frame.

During a first period t1 corresponding to the (N−1)-th input frame in the input vertical synchronization signal Input_Vsync, (N−1)-th frame data DN−1 are written in a first frame buffer FB1. The clock counter 421 is configured to count a clock count of the (N−1)-th input frame and to detect the input frequency of the (N−1)-th input frame.

During a second period t2 corresponding to the N-th input frame in the input vertical synchronization signal Input_Vsync, N-th frame data DN are written in a second frame buffer FB2. The clock counter 421 is configured to count a clock count of the N-th input frame and to detect the input frequency of the N-th input frame (Step S211).

During the second period t2, the synchronization signal generator 423 is configured to detect a change of the input frequency between the (N−1)-th and N-th input frames, and to generate an output synchronization signal (e.g., an output vertical synchronization signal Output_Sync) which includes a vertical blanking period of the (N−1)-th frame and a vertical blanking period of the N-th frame being substantially equal to the vertical blanking period of the (N−1)-th frame.

Referring to FIG. 12, the synchronization signal generator 423 is configured to shift an active period ACN of the N-th frame toward the (N−1)-th frame such that a clock count corresponding to the vertical blanking period VBN of the N-th frame is substantially the same as an average clock count of the vertical blanking period VBN-1 of the (N−1)-th frame and the vertical blanking period VBN of the N-th frame in the output vertical synchronization signal Output_Sync (Step S212).

The (N+1)-th frame data DN+1 received during a third period t3 corresponding to the (N+1)-th input frame, are written in a third frame buffer FB3. During the (N−1)-th frame of the output vertical synchronization signal Output_Vsync, the (N−1)-th frame data DN−1 are read out in the first frame buffer FB1 and then, the (N−1)-th frame data DN−1 in the first frame buffer FB1 are deleted (Step S213).

During a fourth period t4 corresponding to the (N+2)-th input frame of the input vertical synchronization signal Input_Vsync, (N+2)-th frame data DN+2 are written in the first frame buffer FB1 (Step S214).

During a fifth period t5 corresponding to the (N+3)-th input frame of the input vertical synchronization signal Input_Vsync, (N+3)-th frame data DN+3 are written in a fourth frame buffer FB4. During the N-th frame of the output vertical synchronization signal Output_Vsync, the N-th frame data DN are read out in the second frame buffer FB2 and then, the N-th frame data DN in the second frame buffer FB2 are deleted (Step S215).

During a sixth period t6 corresponding to the (N+4)-th input frame of the input vertical synchronization signal Input_Vsync, (N+4)-th frame data DN+4 are written in the second frame buffer FB2 (Step S216).

During a seventh period t7 corresponding to the (N+5)-th input frame of the input vertical synchronization signal Input_Vsync, (N+5)-th frame data DN+5 are written in a fifth frame buffer FB5. During the (N+1)-th frame of the output vertical synchronization signal Output_Vsync, the (N+1)-th frame data DN+1 are read out in the third frame buffer FB3 and then, the (N+1)-th frame data DN+1 in the third frame buffer FB3 are deleted (Step S217).

According to the exemplary embodiment, a shifting amount of the active period in the output synchronization signal may be determined based on a length of the vertical blanking period in the input synchronization signal and a number of the frame buffer may be determined based on the shifting amount of the active period.

According to the exemplary embodiment, length difference between adjacent frames according to a change of the input frequency is compensated by the shifting frame method, and thus display defects such as a tearing defect and a stuttering defect may be substantially minimized. In addition, the inversion signal is generated based on the output synchronization signal and thus an unequal distribution of a polarity between adjacent frames may be substantially minimized and DC afterimage may be substantially minimized.

According to the exemplary embodiments, in the free synchronization mode, different vertical blanking periods in the input synchronization signal may compensate through a frame insertion method and thus, the output synchronization signal including similar vertical blanking periods may be generated. Thus, display defects such as a tearing defect and a stuttering defect may be substantially minimized. In addition, the inversion signal is generated based on the output synchronization signal including similar vertical blanking periods and thus an unequal distribution of a polarity between adjacent frames may be substantially minimized and a DC afterimage may be substantially minimized. In addition, length difference between adjacent frames according to a change of the input frequency is compensated by the shifting frame method, and thus display defects such as a tearing defect and a stuttering defect may be substantially minimized. In addition, the inversion signal is generated based on the output synchronization signal and thus an unequal distribution of a polarity between adjacent frames may be substantially minimized and DC afterimage may be substantially minimized.

Thus, the inventive concept includes a display driver timing controller having a normal synchronization processor for using an unadjusted normal frame rate and a free synchronization processor for using an adjusted frame rate, such as anywhere within the frequency ranges of an FHD or UHD display panel, by frame shifting and/or frame insertion, without limitation.

The foregoing is illustrative of the inventive concept and is not to be construed as limiting thereof. Although a few exemplary embodiments of the inventive concept have been described, those of ordinary skill in the pertinent art will readily appreciate that many modifications are possible in the exemplary embodiments without materially departing from the novel teachings and advantages of the inventive concept. Accordingly, all such modifications are intended to be included within the scope of the inventive concept as defined in the appended claims. Therefore, it is to be understood that the foregoing is illustrative of the inventive concept and is not to be construed as limited to the specific exemplary embodiments disclosed, and that modifications to the disclosed exemplary embodiments, as well as other embodiments, are intended to be included within the scope of the appended claims. The inventive concept is defined by the following claims, with equivalents of the claims to be included therein.

What is claimed is:

1. A display apparatus comprising:

a display panel comprising a plurality of data lines and a plurality of gate lines crossing the plurality of data lines;

a frequency detector configured to receive an input synchronization signal with an input frequency which is variable in a preset frequency range and to count a clock count of an input frame in the input synchronization signal;

a synchronization signal generator configured to generate an output synchronization signal based on the clock count;

a frame data generator configured to generate frame data corresponding to a frame of the output synchronization signal;

an inversion controller configured to generate an inversion signal which has a phase reversed per frame unit based on the output synchronization signal;

a data driver configured to control a polarity of a data voltage based on the inversion signal and to output the data voltage to a data line; and a memory comprising at least one frame buffer which stores an image signal per frame unit, wherein the synchronization signal generator is configured to generate the output synchronization signal which has at least one insertion frame inserted in a vertical blanking period of the input synchronization signal, the vertical blanking period being longer than a frame of maximum frequency, wherein a vertical blanking period of a last insertion frame is substantially equal to a vertical blanking period of a previous insertion frame adjacent to the last insertion frame, and wherein the frame data generator is configured to generate interpolation frame data corresponding to the last insertion frame through a Motion Estimation Motion Compensation (MEMC) method and to generate repetition frame data corresponding to a remaining frame except for the last insertion frame, the repetition frame data being substantially equal to previous input frame data.

2. The display apparatus of claim 1 wherein the generated output synchronization signal has an insertion frame corresponding to the frame of the maximum frequency within the preset frequency range where the insertion frame is inset in the vertical blanking period of the input frame, and the generated insertion frame data corresponds to the insertion frame of the output synchronization signal.

3. The display apparatus of claim 1, further comprising:

a normal synchronization processor configured to receive the input synchronization signal with a normal frequency, to output the output synchronization signal with the normal frequency and to output frame data based on the output synchronization signal.

4. The display apparatus of claim 1, wherein a number of the frame buffer is determined based on a length of the vertical blanking period of the input synchronization signal.

5. The display apparatus of claim 1 wherein the generated output synchronization signal includes adjacent input frames with different input frequencies from each other where one of the adjacent frames is shifted so they have a substantially same vertical blanking period as each other.

6. A method of driving a display apparatus comprising:

receiving an input synchronization signal with an input frequency which is variable in a preset frequency range;

counting a clock count of an input frame in the input synchronization signal;

generating an output synchronization signal based on the clock count;

generating insertion frame data based on the output synchronization signal;

generating an inversion signal which has a phase reversed per frame unit based on the output synchronization signal;

outputting a data voltage having a polarity controlled by the inversion signal to a data line;

storing an image signal in at least one frame buffer;

generating the output synchronization signal which has at least one insertion frame inserted in a vertical blanking period of the input synchronization signal being longer than a frame of maximum frequency;

adjusting a vertical blanking period of a last insertion frame to be equal to a vertical blanking period of a previous insertion frame adjacent to the last insertion frame;

outputting an interpolation frame data in the last insertion frame through a Motion Estimation Motion Compensation (MEMC) method; and outputting a repetition frame data in a remaining frame except for the last insertion frame, the repetition frame data being previous input frame data.

7. The method of claim 6, further comprising:

generating the output synchronization signal which has an insertion frame inserted in the vertical blanking period of the input synchronization signal, the insertion frame corresponding to the frame of the maximum frequency within the preset frequency range; and generating the insertion frame data corresponding to the insertion frame of the output synchronization signal.

8. The method of claim 6, further comprising:

receiving the input synchronization signal with a normal frequency; and outputting frame data based on the output synchronization signal with the normal frequency.

9. The method of claim 6, wherein a number of the frame buffer is determined by a length of the vertical blanking period of the input synchronization signal.

10. The method of claim 6, further comprising:

shifting one of adjacent input frames with different input frequencies from each other based on the clock count to generate the output synchronization signal which includes adjacent frames having a substantially same vertical blanking period as each other; and generating the insertion frame data corresponding to the insertion frame of the output synchronization signal.

* * * * *